US008561991B1

(12) United States Patent
Thistle et al.

(10) Patent No.: US 8,561,991 B1
(45) Date of Patent: Oct. 22, 2013

(54) UNLUCKY SEVENS DICE GAME

(71) Applicants: Barbara May Thistle, Windham, NH (US); Robert Victor Thistle, Windham, NH (US)

(72) Inventors: Barbara May Thistle, Windham, NH (US); Robert Victor Thistle, Windham, NH (US)

(73) Assignee: Barbara May Thistle and Robert Victor Thistle, Windham, NH (US)

( * ) Notice: Subject to any disclaimer, the term of this patent is extended or adjusted under 35 U.S.C. 154(b) by 0 days.

(21) Appl. No.: 13/653,730

(22) Filed: Oct. 17, 2012

Related U.S. Application Data

(60) Provisional application No. 61/684,184, filed on Aug. 17, 2012.

(51) Int. Cl.
*A63F 9/04* (2006.01)

(52) U.S. Cl.
USPC ..... 273/268; 273/274; 273/146

(58) Field of Classification Search
USPC ..... 273/146, 268, 274
See application file for complete search history.

(56) References Cited

U.S. PATENT DOCUMENTS

| | | | | | |
|---|---|---|---|---|---|
| 3,652,086 | A | * | 3/1972 | Stecker | 273/292 |
| 4,443,012 | A | * | 4/1984 | Makovic et al. | 273/292 |
| 4,711,453 | A | * | 12/1987 | Saint Ive | 273/268 |
| 4,927,158 | A | * | 5/1990 | Lierman | 273/268 |

FOREIGN PATENT DOCUMENTS

GB 2154148 A * 9/1985

* cited by examiner

*Primary Examiner* — Benjamin Layno
(74) *Attorney, Agent, or Firm* — Bourque and Associates, PA

(57) ABSTRACT

A dice game utilizes a playing card and game playing elements. Each player in sequence rolls the dice and places a game playing element on the playing card corresponding to the value displayed on the rolled dice. If the player has previously rolled this number, the number may be used by the next player in sequence who needs this number. If a player rolls a 7, he or she forfeits their turn and must remove a game playing element from one of the covered numbers on their playing card. The first person to have all of the numbers on the playing card covered wins the game and the contents of the winner's pot.

3 Claims, 1 Drawing Sheet

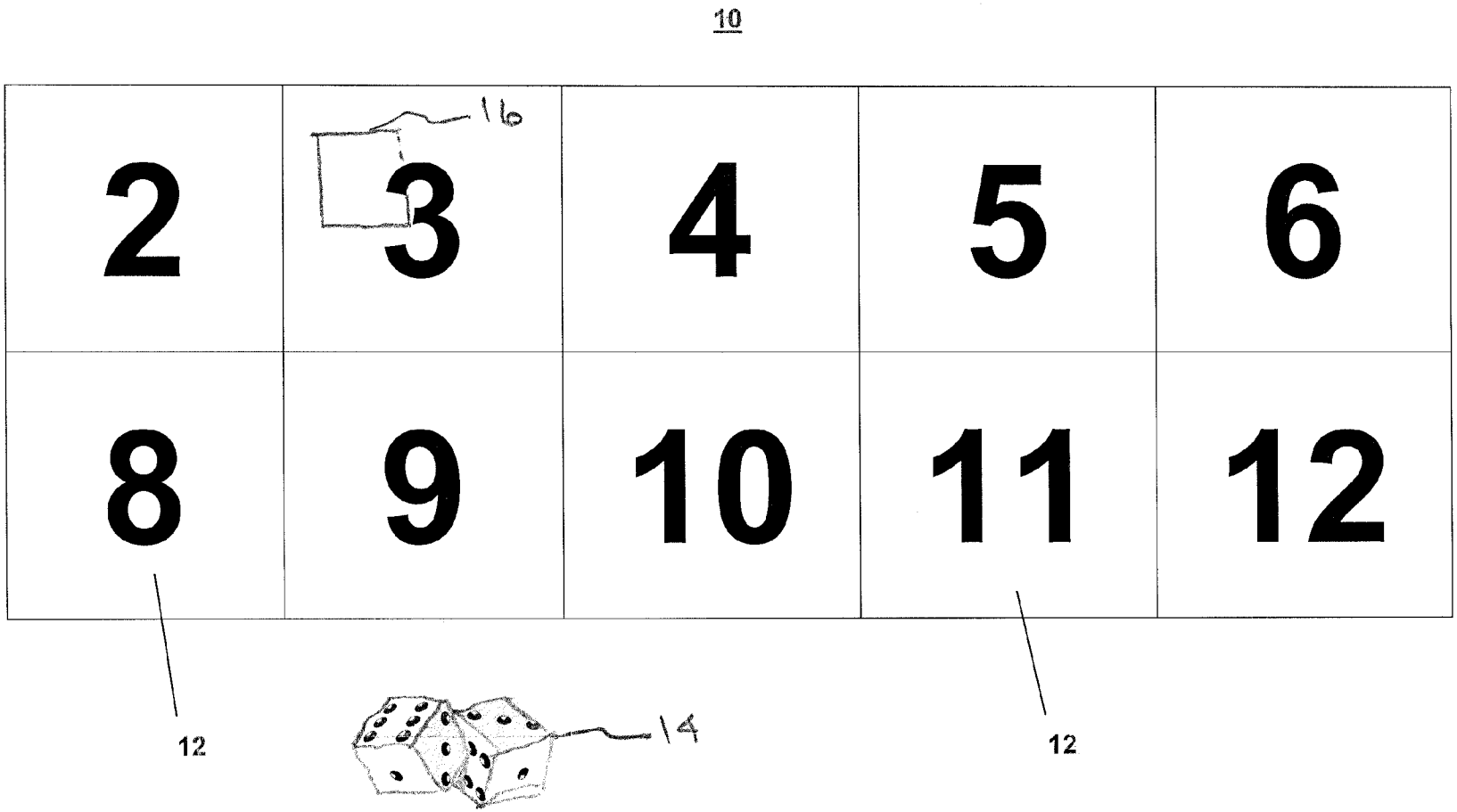
10
2
3
16
4
5
6
8
9
10
11
12
12
14

UNLUCKY SEVENS DICE GAME

CROSS-REFERENCE TO RELATED APPLICATIONS

This application claims priority from U.S. Provisional Application Ser. No. 61/684,184 titled "Unlucky Sevens Game" which was filed on Aug. 17, 2012 of which is incorporated fully herein by reference.

TECHNICAL FIELD

The present invention relates to multiple player games and more particularly, relates to a multi-player dice game played with standard dice and a game board or card.

BACKGROUND INFORMATION

Dice games for multiple players have been in existence for many years and are well known and much enjoyed by many individuals. Although there are many games that are played with dice and game boards or game cards, a need exists for a new dice game that is easy to play for almost all age levels from youngsters to senior citizens and which is enjoyable and stimulating.

SUMMARY OF THE INVENTION

The invention features a method of playing a dice game by multiple players. The method comprises the acts of providing multiple dice, wherein each dice includes numerical indicia on each of its sides and providing each of said multiple players a plurality of game playing elements. Next is the act of providing a game card/board including separate game playing element receiver regions, each game playing element receiver region including one of at least the numbers 2 through 6 and 8 through 12. The multiple dice are rolled by a first player following which the game proceeds by adding the numeric total of each of the rolled multiple dice by the first player. Responsive to the numeric total, the first player determines whether the numeric total is 7. Responsive to the numeric total being 7, the first player removes a game playing element from one of the game playing element receiver regions on the first player's game card/board and places the removed game playing element into a winner's pot, or removes a game playing element from the plurality of game playing elements assigned to the first player and places the removed game playing element into the winner's pot.

Responsive to said numeric total not being 7, the first player determines whether a game playing element receiver region on the first player's game card/board includes a game playing element receiver region wherein the numeric total has or has not previously been covered by a game playing element. Responsive to the act of determining that the game playing element receiver region having the numeric total of the rolled multiple dice has not been previously covered by a game playing element, the first player places a first game playing element on a game playing element receiver region of the game card/board including the numeric total of each of the rolled multiple dice.

Responsive to the act of determining that the game playing element receiver region having the numeric total of the rolled multiple dice has been previously covered by a game playing element, play of the game moves to a second or subsequent player who does not have his or her game playing element receiver region including the numeric total rolled by the first player covered.

The first player subsequently determines whether each of the rolled multiple dice includes the same numeric value (i.e. doubles) in which case the first player rolls the multiple dice a subsequent time and repeats the steps of adding the numeric total of each rolled multiple dice in determining whether a game playing element receiver region on the first player's game card/boards includes a game playing element receiver region wherein the numeric total has or has not been previously covered by a game playing element.

After the first player has rolled multiple dice and determined that each of said rolled multiple dice does not include the same numeric value, play continues to a second and subsequent player who repeats the steps of rolling the multiple dice, adding the numeric value of each of the rolled multiple dice and determining whether the second and subsequent player's game card/board includes a game playing element receiver region wherein the numeric total of the multiple dice has or has not previously been covered by a game playing element following the acts set forth above.

After at least one of the multiple players determines that the player's game playing element receiver region on the player's game card/board is covered by a game playing element, determining that the at least one player has won the game wherein the at least one player receives the contents of the winner's pot and receives from each of the remaining multiple players who did not win the game, one game playing element for each of said players' game playing element receiver region which is not covered by a game playing element.

BRIEF DESCRIPTION OF THE DRAWINGS

These and other features and advantages of the present invention will be better understood by reading the following detailed description, taken together with the drawings wherein:

FIG. 1 is a representation of a game card utilized with the dice game of the present invention.

DETAILED DESCRIPTION OF THE PREFERRED EMBODIMENTS

The present invention features a dice game that is played with two standard dice 14, a game board or card 10 as shown in FIG. 1, a bowl or receptacle, and several game playing elements 16 such as, for example, coins (nickels, dimes, quarters or any other denomination) or chips or other coin equivalents that are utilized to play the game. The game may be played by 2 or more players, with 10 players being a reasonable maximum number of players although not a limitation of the invention.

The dice game may be played using real currency or look-alike currency, chips or any other similar item. The game is played as follows. First, all players "ante up" a predetermined amount into the bowl or container which serves as the "winner's pot". In order to determine which player goes first, all players roll the dice (either one or 2 dice per person) and the person with the highest total number from his or her dice (or lowest number if the players agree ahead of time) will start the game.

The first player throws his or her dice (2 dice) and adds the total of the dice, and utilizes one of the game elements to cover the total on the corresponding number 12 on the game card 10. If that corresponding number 12 on the game card is already covered, the play moves on (clockwise or counter-clockwise—whatever is agreed upon ahead of time) to the next player in turn that needs that number. The next player in line that needs that number "uses" it and simply covers his or her number. Any players in turn who have not used the number essentially skip their turn and play continues to the next player after the player who used the number. If all of the players have that number covered, then the play is dead and the next player rolls the dice.

If the first player throws a 7 (the total of the dice) he or she must remove a game playing element from any number that is covered on his or her playing card. A player should avoid, if possible, removing a game playing element from the numbers 2 or 12 as these are the more difficult numbers to roll with a pair of dice. If the player's playing card is empty, he or she must still put a game playing element into the winner's pot.

If a player throws doubles (same number on each dice, the player is eligible to roll the dice again (and can continue to roll the dice as long as he or she rolls doubles. The first player that has their card completely covered wins the game and the coins or other game playing elements in the winner's pot. In addition, once the game ends by one player having their card completely covered, all of the remaining players must put one game playing element into the winner's pot for each of the uncovered numbers on their playing card. In addition, players may decide ahead of time that if one player rolls a winning number for another player, they will split the winner's pot. Other similar modifications and additions to these rules may be developed or decided upon by the players, all within the scope of the present invention.

Modifications and substitutions by one of ordinary skill in the art are considered to be within the scope of the present invention, which is not to be limited except by the allowed claims and their legal equivalents.

The invention claimed is:

1. A game, effective for stimulating enjoyment and interaction between two or more family and friends, said game comprising:

a plurality of game playing components, said plurality of game playing components comprising:

multiple dice, wherein each of said multiple dice includes numerical indicia on each of its sides;

a winner's pot, configured for receiving collected game playing elements;

a plurality of game playing elements; and a plurality of game card/boards, one game card/board for each of said at least two or more family and friends playing said game, each of said game card/board having a front surface including separate game playing element receiver regions, each game playing element receiver region including one of at least the numbers 2 through 6 and 8 through 12; and wherein the game is played as follows:

rolling two of the multiple dice by a first player;

adding the numeric total of each numerical indicia on one side of each of the rolled two of the multiple dice by the first player;

responsive to said added numeric total of said numerical indicia on one side of each of the rolled two of the multiple dice, said first player determining whether said numeric total is 7;

responsive to said numeric total being 7, said first player removing a game playing element from one of said game playing element receiver regions on said first player's game card/board and placing said removed game playing element into said winner's pot, or removing a game playing element from said plurality of game playing elements assigned to said first player and not yet on said game board and placing said removed game playing element into said winner's pot;

responsive to said numeric total not being 7, said first player determining whether a game playing element receiver region on said first player's game card/board having a number corresponding to said added numeric total of said numerical indicia on one side of each of the rolled two of the multiple dice has or has not previously been covered by a game playing element;

responsive to said act of determining that said game playing element receiver region having said added numeric total of said numerical indicia on one side of each of the rolled two of the multiple dice which has not been previously covered by a game playing element, said first player placing a game playing element on a game playing element receiver region of said game card/board having a number corresponding to said added numeric total of numerical indicia on one side of each of the rolled two of the multiple dice;

responsive to said act of determining that said game playing element receiver region having said numeric total of said rolled multiple dice has been previously covered by a game playing element, play moving to a second or subsequent player who does not have his or her game playing element receiver region on his or her game playing card/board including said numeric total rolled by said first player covered;

said first player subsequently determining whether each of said numerical indicia on one side of each of the rolled two of the multiple dice includes the same numeric value, in which case said first player rolls said two multiple dice a subsequent time and repeats the steps of adding the numeric total of each numerical indicia on one side of each of the rolled two of the rolled multiple dice in determining whether a game playing element receiver region on said first player's game card/boards includes a game playing element receiver region wherein said numeric total has or has not been previously covered by a game playing element;

after said first player has rolled said two multiple dice wherein each of said rolled multiple dice does not include the same numeric value, play continuing to a second and subsequent player who repeats the steps of rolling two multiple dice, adding the numeric value of numerical indicia on one side of each of the rolled two of the multiple dice and determining whether the second and subsequent player's game card/board includes a game playing element receiver region wherein said numeric total of said multiple dice has or has not previously been covered by a game playing element;

repeating the sequence said game playing acts set forth above; and after at least one of said multiple players determines that each of said player's game playing element receiver regions on the player's game card/board is covered by a game playing element, determining that said at least one player has won the game wherein said at least one player receives the contents of said winner's pot and receives from each of the remaining multiple players who did not win the game, one game playing element for each of said players' game playing element receiver regions which is not covered by a game playing element.

2. The method of claim 1, wherein each of said multiple players is provided with 2 dice, each dice having six sides, each said six sides having a different numerical indicia from 1 through 6.

3. The method of claim 2, wherein each of said multiple players plays with the same set of 2 dice.

* * * * *